US005178730A

United States Patent [19]

Bixler et al.

[11] Patent Number: 5,178,730

[45] Date of Patent: Jan. 12, 1993

[54] PAPER MAKING

[75] Inventors: Harris J. Bixler, Belfast; Stephen Peats, Camden, both of Me.

[73] Assignee: Delta Chemicals, Searsport, Me.

[21] Appl. No.: 537,061

[22] Filed: Jun. 12, 1990

[51] Int. Cl.[5] ..... D21H 21/10

[52] U.S. Cl. ..... 162/168.3; 162/164.3; 162/164.6; 162/168.2; 162/181.1; 162/181.8; 162/183

[58] Field of Search ..... 162/183, 181.8, 168.2, 162/168.3, 164.6, 181.1, 164.3

[56] References Cited

U.S. PATENT DOCUMENTS 4,711,727 12/1987 Matthews et al. ..... 162/181.8
4,749,444 6/1988 Lorz et al. ..... 162/168.3
4,753,710 6/1988 Langley et al. ..... 162/168.3

*Primary Examiner*—Peter Chin
*Attorney, Agent, or Firm*—Ladas & Parry

[57] ABSTRACT

A process for improving art chemistry in papermaking is accomplished by the addition of a cationic polymer and natural hectorite to the furnish prior to headbox. The cationic polymer has an intrinsic viscosity in the range of 5 to 25 dl/g and a charge density of 0.78 to 5 equivalent cationic nitrogen per Kg. The natural hectorite is added in an amount of 0.5 to 6 lbs/ton dry base sheet and the weight ratio of cationic polymer to natural hectorite being 0.5:1 to 10:1.

15 Claims, 1 Drawing Sheet

PAPER MAKING

BACKGROUND OF THE INVENTION

1. Field of the Invention

Figure 1:
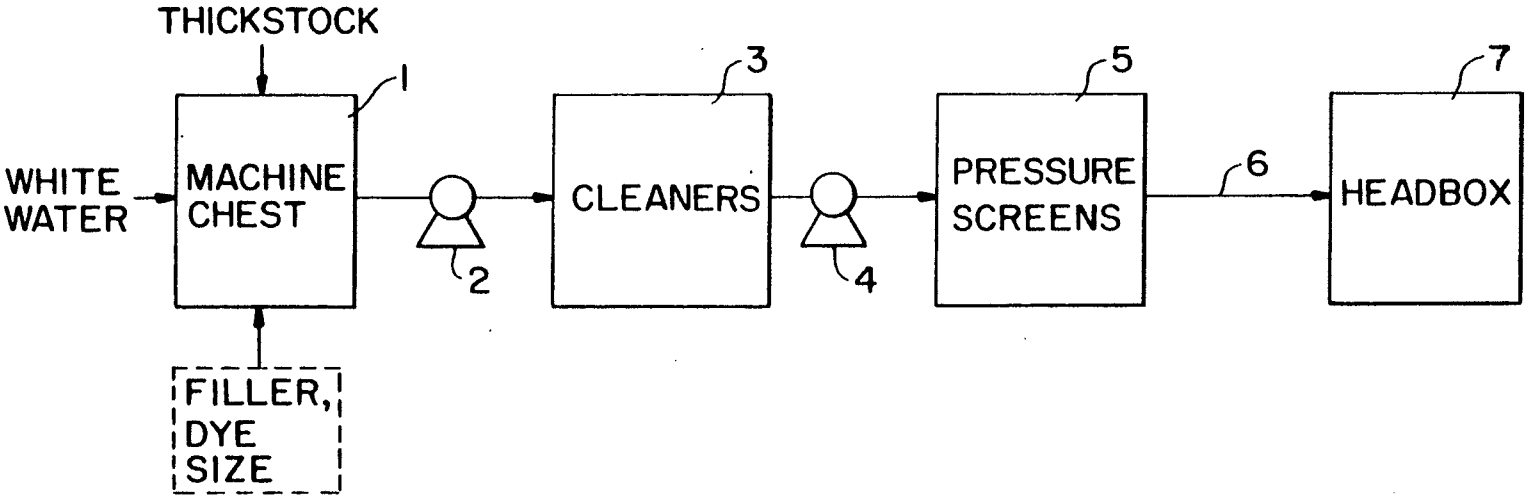

The present invention relates to paper making. In particular, it relates to a multi-component system for improving wet-end chemistry in paper making.

2. Brief Description of the Prior Art

In order to try to reduce the cost of paper and modify certain paper properties various expedients have been tried. Among these have been attempts to replace cellulosic fibers by filler materials such as kaolin clays. It has, however, proved to be difficult to maintain satisfactory quality, especially as the ratio of filler to fiber is increased.

Currently, many paper makers attempt to maximize filler and pulp fines retention by addition of a high molecular weight water soluble polymer, such as a derivatized polyacrylamide in an amount of from 0.3 to 1.5 lbs per ton of paper produced. The derivatized polyacrylamide used may be cationic or anionic in nature and in general it has been found that the higher the molecular weight of the material used, the greater has been the retention. On the other hand, as the molecular weight of the polyacrylamide increases, sheet formation deteriorates. Similarly, as the amount of polyacrylamide is increased, fines retention improves and sheet formation deteriorates.

A further problem confronted by paper makers is the removal of water from the furnish slurry when this is passed from the headbox of a paper making machine on to the moving wire belt on which paper sheet forms. Initially, water simply drains through the wire belt. As the belt progresses away from the headbox, the furnish slurry, from which the paper is forming, is subjected to additional drainage techniques such as vacuum assisted drainage. After this, the paper now has sufficient structural integrity to be removed from the wire belt and passed over heated rollers which lowers the moisture content even further to produce the finished product. The greater the amount of moisture that drains off on the initial section, namely the wire belt, the less is the cost of subsequent drying operations. Such early removal of water can be assisted by the presence of suitable drainage aids in the furnish. Low to intermediate molecular weight cationic synthetic polymers such as those based on polyacrylamide, polyethylene imine, polymers produced from dimethylamine and epichlorohydrin and polydiallyldimethyl ammonium chloride are examples of drainage aids currently in use.

Binder compositions comprising acrylic polymers are described, for example, in U.S. Pat. No. 4,298,513 (Distler et al).

U.S. Pat. No. 2,616,818 (Azodosa) describes an acrylamide-based paper coating composition.

U.S. Pat. No. 3,483,077 (Aldrich) describes the use of cationic thermosetting resins together with clays in paper making.

U.S. Pat. No. 2,795,545 (Gluesenkamp) describes the use in paper making of various clays such as bentonite in conjunction with polycations obtained by polymerization of monolefin compounds such as polydimethylaminoethyl methacrylate derivatives, polyvinylbutylpyridinium bromide, poly-2-methyl-5-vinyl pyridine and quaternary salts of styrene/methylvinylpyridine copolymers.

U.S. Pat. No. 4,305,781 (Langley et al) describes an improvement to furnish drainage rates using bentonite and high molecular weight substantially non-ionic polymers.

U.S. Pat. Nos. 3,697,370 (Nagy) and 3,732,173 (Nagy) disclose methylamine-epichlorohydrin polymers and their use in the manufacture of dry strength paper.

U.S. Pat. No. 3,288,770 (Butler) discloses polydiallyldimethylammonium chloride and methods of making it. The polymers may be used as wet strength improvement agents for papers.

U.S. Pat. No. 3,738,945 (Panzer et al) describes polyquaternary polymers derived from an epihalohydrin and a secondary amine i.e., dimethylamine. The main use of the polymers is as flocculants.

U.S. Pat. No. 2,884,058 (Schuller et al) features a copolymer of acrylamide and diallyldimethylammonium chloride and its use in paper making.

U.S. Pat. No. 4,432,834 (Whitfield et al) discloses a composition for addition to cellulosic fibers prior to felting them into a sheet comprising as component (a) a monomeric water soluble diallyl dimethyl ammonium halide or homopolymer thereof or mixtures thereof and as component (b) a water dispersible complex fatty amido compound, the proportion of (a) and (b) being sufficient to enhance softness of the dried sheet while increasing or not substantially reducing absorbency of water and tensile strength.

U.S. Pat. No. 4,171,417 (Dixon) teaches copolymers of dialkyl diallyl ammonium chloride and their use for making electroconductive paper.

U.S. Pat. No. 4,753,710 (Langley) teaches a process of adding a high molecular weight cationic polymer to a paper furnish followed by high shear and then subsequently adding bentonite to improve retention, drainage, drying, and formation. Also F167736 and W086/05826 discuss the use of cationic polymeric materials with colloidal silica.

U.S. Pat. No. 4,749,444 (Lorz) teaches that good printing quality paper can be made when three components are added to the paper stock for improved drainage and retention. These three components are water swellable clay referred to as a bentonite, within which definition other clays, including hectorite are apparently comprised, a low molecular weight, high charge density, cationic polymer and a high molecular weight derivatized polyacrylamide or polymethacrylamide.

U.S. Pat. No. 3,052,595 teaches the use of polyacrylamide and bentonite as a drainage and retention aid with high shear after the addition of the polyacrylamide.

U.S. Pat. No. 4,097,427 (Aitken et al) features the cationization of starch with polymers such as dimethylamine-epichlorohydrin and polydiallyldimethylammonium chloride. U.S. Pat. No. 4,146,515 (Buikema et al) has similar teachings.

U.S. Pat. No. 3,772,076 (Keim) describes reaction products of epihalohydrin and polymers of diallylamine and their use as wet strength agents for paper.

U.S. Pat. No. 3,520,774 (Roth) relates to a epichlorohydrinpolyethyleneimine reaction product and its use as a wet strength additive for paper.

U.S. Pat. No. 4,129,528 (Petrovich) teaches polyamine-epihalohydrin resinous reaction products and their use as wet and dry strength additives for paper.

U.S. Pat. No. 4,330,365 (Tessler) describes the use of cationic polymers wherein poly (n-N'-methyl bisacrylamide coamine) is grafted onto starch as a replacement for starch in paper making, for example, a pigment retention aid.

U.S. Pat. No. 4,198,269 (Evani) describes the use of cationic polyethers preferably having molecular weights in the range 10,000 to 60,000 as wet or dry strength enhancers for paper.

U.S. Pat. No. 3,930,877 (Aitken) describes the use of an epichlorohydrin dimethylamine condensate as a cationic additive for starch in paper making to assist in improving burst strength and pigment retention.

U.S. Pat. No. 3,278,474 (Nixon et al) describes the use of copolymers of unsaturated aldehydes and quaternary ammonium compounds to improve wet strength and abrasion resistance of paper.

U.S. Pat. No. 4,824,523 (Wagberg et al) uses a mixture of anionic and cationic polymers as additives to starch to improve the retention and dry strength properties of paper. The cationic polymers used are chosen from a wide variety of types including polyacrylamides modified by reaction with formaldehyde and dimethylamine, polydiallyldialkyl ammonium halides, cationic amido amines and polymers by polymerization of N-(dialkyl aminoalkyl) acrylamide monomers.

U.S. Pat. No. 4,818,341 (Degan) suggest use of a cationic polymer comprises copolymerized units of diallyldimethyl ammonium chloride and N-vinylamine or an N-vinyl imidazoline as a dry strength enhancer for paper and as an aid to dewatering of paper stock in sheet formation.

U.S. Pat. No. 4,785,055 (Dester et al) describes the use of the reaction product of an acidified polyacrylamide and a halide or halogen to produce a polymer that is useful as a wet strength enhancer in paper making.

U.S. Pat. No. 4,722,964 (Chan et al) describes improved cationic wet strength resins prepared from an epichlorohydrin ammonia reaction product and polyalkyleneamine amide and epichlorohydrin.

U.S. Pat. No. 4,711,727 (Matthews) describe the use of synthetic hectorite in an alkaline medium together with cationic and amphoteric electrolytes such as polyamines and dimethyldiallyl ammonium chloride for use as slurry stabilizing agents and flocculants in the treatment of sewage and in paper making.

Commonly, assigned copending application Ser. No. 07/211,550, filed on Jun. 24, 1988, (and its corresponding International Application published as WO 89/12661 on Dec. 28, 1989) the contents of which are herein incorporated by reference, describe the use of cationic starch together with hectorite in paper making. It contains a discussion of prior use of starch materials in binders for use in paper making.

SUMMARY OF THE INVENTION

We have now found that if we add a medium/high molecular weight polymer to a furnish and then shear it and thereafter add hectorite to the furnish and then feed it to a headbox of a paper making machine without further shearing, we can achieve improved filler (fiber and fines) retention without loss of sheet formation and that even in the absence of such fillers improved drainage rates are possible in sheet formation.

Hectorite is a unique mineral (a smectite) that in this invention is superior in performance to the related clays of the montmoriilonite type, e.g. bentonite. Naturally mined, sodium exchanged hectorite when used in the process of the present invention gives better retention and drainage when compared with montmorillonites in both alkaline paper furnish ($CaCO_3$ filler, pH 7.5–8.5) and acid paper furnish (Kaolin filler, pH 4.0–5.6). The advantage of hectorites is particularly noticeable when polyacrylamides of low cationic substitution, less than 1 equivalent of nitrogen per kg, are utilized. This is consistent with our findings in copending application Ser. No. 07/211,550 that hectorites give much better retention with cationic starches than do bentonites where the degree of derivatization of the starches is typically 0.15 equivalents of nitrogen per kg. This effect is evident when cationic starch is added to the furnishes, where the synthetic hectorite is particularly effective and the bentonite, shows little response.

In the past, the literature has not been entirely consistent with the nomenclature used with respect to clays. For example, U.S. Pat. No. 4,753,710 describes bentonite and bentonite-type clays as anionic swelling clays such as sepiolite, attapulgite, or, preferably, montmorillonite. This patent also references the broader bentonite description in U.S. Pat. No. 4,305,781 (commercial bentonites, montmorillonite clays, Wyoming bentonite and Fullers Earth). U.S. Pat. No. 4,749,444 describes bentonites as sheet silicates which are water swellable including nontronite, hectorite, saponite, volkonskoite, sauconite, beidellite, allevarlite, illite, halloysite, attapulgite and sepiolite. It is generally accepted in current clay mineralogy texts that many of these minerals are not normally found in bentonite and should not be classified with it, e.g., several of them are not in the smectite group (allevarlite, illite, halloysite, attapulgite, and sepiolite) and a few of them do not even swell (illite, attapulgite and sepiolite). Unless the context requires otherwise when used herein the term "bentonite" refers to true bentonite (i.e., a dioctahedrial smectite.)

When used herein the term "hectorite" means true hectorite namely the trioctahedial smectite and includes naturally occurring clays thereof. These materials, to be effectively water swellable and dispersable must possess monovalent cations, preferably, sodium as the predominant exchangeable cation. However, the hectorite clay materials may also contain other multivalent exchangeable cations such as calcium, magnesium and iron.

Hectorite materials are characterized by their relatively high cation-exchange capacities. Kaolin and talc clay material used as fillers in paper making on the other hand have low cation-exchange capacity. Hectorites have exchange capacities in the range 80–150 milliequivalent per 100 g, whereas bentonites have exchange capacities in the range 60–90 milliequivalents per 100 g. and kaolin and talc exchange capacities are 3–5 milliequivalent per 100 g or less. It is this high anionic charge density that is essential for hectorite to be effective in this binder.

Naturally occurring hectorite material that possesses a predominant amount of exchangeable divalent cation such as calcium can be converted, in a post-mining process, from a non-swelling to a swelling form. One process for carrying out this ion exchange is called "peptizing" and is well known in the clay processing industry. It exchanges a monovalent cation such as sodium for the calcium ions. Such peptized clays may be used in the present invention.

When used in present invention the peptized hectorite material is dispersed and swollen in an aqueous solution where it assumes a sol structure of individual platelike particles or small aggregates of particles. The thickness of the individual plates is from 1 to 5 nm and the surface dimensions are typically 250–500 nm. It is necessary that the individual clay particles possess dimensions of this order of magnitude so that they are truly colloidal in behavior. The preparation of the smectite clay material sols for use in this invention must be performed in such a way as to assure that a large percentage of individual platelets are present in the binder.

Medium or high molecular weight cationic charged polymers of use in the present invention are typically those having a molecular weight as characterized by intrinsic viscosity in the range of 5 to 25 dl/g and having a charge density of from 0.01 to 5 equivalents of cationic nitrogen per kg as measured by polyelectrolyte titration (0.1% to 50% mole substitution). Such polymers include in addition to the quaternized Mannich polyacrylamides, polymers such as tertiary amine Mannich polyacrylamides, quaternized and unquaternized copolymers of dimethylamino ethyl(meth) acrylate and acrylamide, polyethylene imines, polyamine epichlorohydrin polymers and homo- and co-polymers (with acrylamide) of diallyldimethylammonium chloride.

We have found tertiary amine and quaternary amine derivatives of linear polyacrylamides having intrinsic viscosities in the range 6 to 18 dl/g and with charge densities in the range of 0.5 to 3.5 equivalents cationic nitrogen per kg polymer to be particularly useful.

The hectorite/medium or high molecular weight charged polymer system of the present invention may be used in paper making as a drainage aid in the absence of a filler. It will also frequently be employed in conjunction with fillers, such as kaolin, calcium carbonate, talc, titanium dioxide, barium sulfate, calcium, bentonite or calcium sulfate in which case it will act as both a drainage aid and a binder for the filler, both fiber and fines. It will also frequently be employed in conjunction with sizing agents, colorants, optical brighteners and other minor ingredients of commercial paper-making furnishes. The system continues to perform its intended purpose in the presence of the additives.

The polymer and the hectorite material are typically employed in weight ratios of from 0.25 to 10:1 more preferably in the range 0.5:1 to 4:1. Typically, hectorite will be added in amounts to produce a concentration in the paper stock of hectorite in the range 0.5 to 6 lbs/ton dry base sheet, preferentially, in the range 1 to 4 lbs/ton dry base sheet. The polymer will typically be added in amounts to produce a concentration of 0.5 to 4, preferably 1.5 to 2.5 lbs/ton of dry base sheet.

Additions of a charge-bearing starch say from 1 to 30, preferably 2 to 10 lbs/ton of furnish, for example, amounts that result in a weight ratio of starch to hectorite of 0.25 to 15:1, preferably 1 to 8:1 may also be present as a wet or dry strength additive. Such starch is conveniently a cationic starch having a degree of substitution above 0.03 (0.15 equivalents of nitrogen per kg starch). Alternatively, however, an amphoteric starch may be used. Particularly useful starches are potato starch, waxy maize starch, corn starch, wheat starch and rice starch.

The binder of the present invention is added to the paper making stock after other furnish ingredients have been added but prior to its introduction to the paper machine headbox. The binder must be formed in situ in the stock by adding the cationic polymer and hectorite sequentially with adequate mixing between additions. To avoid excessive flocculation of the paper furnish and to assure good formation of the paper sheet on the machine wire, the polymer is added prior to the last point of high shear and the hectorite is added after this shear point. After the hectorite addition, further significant shear should be avoided. Typically, the shear stress employed after the addition of the polymer and before addition of hectorite is at least 1000 Pascals (1,000 rpm in a Britt drainage jar), although shear stresses of up to 10,000 Pa or more may be preferred. After addition of the hectroite, shear stresses of more than 1000 Pa should be avoided. It will, however, be appreciated that some continued shear may be necessary for proper mixing of the hectorite. The shear stresses applied, however, should be such as to avoid shearing of the polymer-hectorite complex. The application of shear is conveniently accomplished by passing the furnish through a fan pump (such fans typically impart a shear stress of the order of 20,000 Pa) or by passage through pressure screens (which typically impart a shear stress of about 10,000 Pa).

A useful guide to shear stresses at various parts of a paper making plant is found in an article by Tam Doo et al in Journal of Pulp and Paper Science, July 1984. According to this paper, fan pumps, pressure screens and table rolls all achieve a shear stress of 1,000 Pa or more (this being equivalent to the shear stress experienced in a drainage jar at 1,000 rpm) but other wet end components such as flow distributors, rectifier rolls, slices, jet impingements and foils all create shear stresses below this value.

Typically addition of the cationic polymer is made to the thin stock prior to the pressure screens (centriscreens) and/or fan pumps and the hectorite after the pressure screens and fan pump. The cationic polymer must be added prior to hectorite. Other furnish ingredients are added to the thick stock prior to dilution or to the stuff box tank after dilution but ahead of the centriscreens and the fan pump(s) and the addition point of the polymer portion of the present binder system.

The binder of the present invention can be used with a variety of paper making furnishes including those based on chemical, thermomechanical and mechanical treated pulps from both hard and softwood sources.

A flow diagram of a typical paper machine in which the present invention may be used is shown in FIG. 1. Thick stock, white water and other components are all mixed in the machine chest, 1. As explained above, the polymers of the present invention are added after the machine chest but prior to the last shear taking place (i.e. prior to the last of the fan pumps, 4, and pressure screens, 5). After this has occurred and the furnish has passed through the fan pumps, 2 and 4, cleaners, 3, and pressure screens, 5, hectorite is added and the furnish to produced passes via line, 6, into the headbox 7.

The present invention will now be illustrated by the following Examples:

EXAMPLE 1

An alkaline paper furnish was prepared from a thick paper stock and white water obtained from an operating paper mill. The furnish had a total consistency of 0.76% (66% fiber, 34% fines), a pH of 8.0 and a conductivity of 545 $\mu$mhos $cm^{-1}$.

Two cationic polyacrylamides (PAM) were tested. CD31HL, produced by Allied Colloids, is a high molecular weight cationic polyarylamide based copolymer of medium cationic charge. 4209A, produced by Delta Chemicals, is also a high molecular weight cationic quaternized dialkyl amino methylene polyacrylamide of medium cationic charge (IV=18 dl/g; 0.6 equivalents cationic N/kg polymer). Both polymers were put into solution in water as a concentration of 0.14 weight percent prior to introduction to the paper furnish.

Two colloidal suspensions were utilized, both made up at 0.14 weight percent in water. The first was a synthetic hectorite suspension DAC3, prepared at Delta Chemicals, and the second, a naturally occurring bentonite, 2D5, sold by Allied Colloids.

Fines retention values were obtained utilizing a Britt Dynamic Drainage Jar. The furnish was poured into the Britt Jar and stirring commenced at 1,000 rpm. This speed was maintained for 25 seconds after which it was increased to 2,000 rpm. The polyacrylamide was added and the stirring continued at 2,000 rpm for 60 seconds. The speed was then reduced to 1,000 rpm and the colloid added. Stirring was continued for 15 seconds at which time a drainage sample was collected, filtered and dried.

Drainage rates were determined by transferring the furnish as described and prepared above to a drainage tube. The time to drain a set volume was then determined.

Table 1 clearly shows that DAC3 gives the best combination of retention and drainage.

TABLE 1

| PAM (lbs/Ton) | PAM Type | Colloid (lbs/Ton) | Colloid Type | Fines Retention (%) | Drainage Rate (mls/sec) |
|---|---|---|---|---|---|
| — | — | — | — | 20.4 | 0.80 |
| 1.0 | 4209A | — | — | 39.4 | 0.92 |
| 2.0 | 4209A | — | — | 45.9 | 1.14 |
| 4.0 | 4209A | — | — | 52.3 | 1.26 |
| 2.0 | 4209A | 0.5 | DAC3 | 50.7 | 1.15 |
| 2.0 | 4209A | 1.0 | DAC3 | 53.9 | 1.20 |
| 2.0 | 4209A | 2.0 | DAC3 | 62.8 | 1.54 |
| 1.0 | CD31HL | — | — | 36.3 | 0.88 |
| 2.0 | CD31HL | — | — | 41.5 | 1.26 |
| 4.0 | CD31HL | — | — | 51.5 | 1.70 |
| 2.0 | CD31HL | 0.5 | 2D5 | 46.9 | 1.07 |
| 2.0 | CD31HL | 1.0 | 2D5 | 51.1 | 1.26 |
| 2.0 | CD31HL | 2.0 | 2D5 | 60.0 | 1.24 |

EXAMPLE 2

An alkaline paper furnish was prepared as in the manner outlined in Example 1, and had a consistency of 0.92% (66% fiber, 34% fines), a pH of 8.0 and a conductivity of 636 $\mu$mhos $cm^{-1}$. Two polyacrylamides and three colloids were tested. The cationic polyacrylamides are quaternized dialkyl amino methylene derivatives of polyacrylamide, produced by Delta Chemicals, designated as 4209A (high molecular weight, medium cationic charge) (IV=18 dl/g; 0.6 equivalents cationic N/kg polymer) and 4240A (high molecular weight, high cationic charge) (IV=18 dl/g; 2.5 equivalents cationic N/kg polymer). The three colloids were DAC1, a natural hectorite, DAC3 a synthetic hectorite, both supplied by Delta Chemicals, Inc., and 2D5 a bentonite supplied by Allied Colloids.

The furnish was treated and tested as in Example 1. DAC1, a hectorite, gave increased fines retention far in excess of 2D5, a bentonite.

Table 2 shows that DAC1 is superior to 2D5 in terms of fines retention.

TABLE 2

| PAM (lbs/Ton) | PAM Type | Colloid (lbs/Ton) | Colloid Type | Fines Retention (%) |
|---|---|---|---|---|
| — | — | — | — | 38.7 |
| 2.0 | 4209A | — | — | 58.3 |
| 2.0 | 4209A | 2.0 | DAC1 | 83.8 |

TABLE 2-continued

| PAM (lbs/Ton) | PAM Type | Colloid (lbs/Ton) | Colloid Type | Fines Retention (%) |
|---|---|---|---|---|
| 2.0 | 4209A | 2.0 | DAC3 | 68.9 |
| 2.0 | 4209A | 2.0 | 2D5 | 63.3 |
| 2.0 | 4240A | — | — | 63.9 |
| 2.0 | 4240A | 2.0 | DAC1 | 81.9 |
| 2.0 | 4240A | 2.0 | DAC3 | 68.0 |
| 2.0 | 4240A | 2.0 | 2D5 | 67.3 |

EXAMPLE 3

An acid paper furnish was obtained from an operating paper mill having a total consistency of 0.40% (53% fiber, 47% fines), a pH of 4.0 and a conductivity of 678 $\mu$mhos $cm^1$.

The fines retention and drainage rate values were obtained as per procedures outlined in Example 1. The two high molecular weight cationic polyacrylamides, CD31HL and 4209A, along with the colloidal suspensions, DAC3, and DAC1 were prepared at 0.07 weight percent in water.

Table 3 shows that DAC1 and DAC3 give both better fines retention and drainage.

TABLE 3

| PAM (lbs/Ton) | PAM Type | Colloid (lbs/Ton) | Colloid Type | Fines Retention (%) | Drainage Rate (mls/sec) |
|---|---|---|---|---|---|
| — | 4209A | — | — | 15.5 | 1.38 |
| 0.5 | 4209A | — | — | 18.7 | 1.25 |
| 1.0 | 4209A | — | — | 26.9 | 1.24 |
| 2.0 | 4209A | — | — | 32.6 | 1.55 |
| 4.0 | 4209A | — | — | 46.6 | 2.31 |
| 2.0 | 4209A | 0.5 | DAC3 | 44.3 | 2.73 |
| 2.0 | 4209A | 1.0 | DAC3 | 49.6 | 3.49 |
| 2.0 | 4209A | 2.0 | DAC3 | 53.7 | 4.05 |
| 2.0 | 4209A | 4.0 | DAC3 | 53.8 | 4.05 |
| 2.0 | 4209A | 0.5 | DAC1 | 38.7 | 2.17 |
| 2.0 | 4209A | 1.0 | DAC1 | 44.3 | 2.88 |
| 2.0 | 4209A | 2.0 | DAC1 | 55.0 | 4.55 |
| 2.0 | 4209A | 4.0 | DAC1 | 65.9 | 5.77 |

EXAMPLE 4

An alkaline paper furnish was obtained from an operating paper mill having a total consistency of 0.69%, and a pH 7.35, and conductivity of 442 $\mu$mhos $cm^{-1}$.

Drainage rates were determined by treating a sample of furnish as outlined in Example 1 and then transferring the heated furnish to a drainage tube.

A medium molecular (IV=7 dl/g; 0.8 equivalents cationic N/kg polymer) weight, medium cationic charged polyacrylamide, Percol 292, supplied by Allied Colloids, was employed at 0.1 weight percent.

The colloid suspensions DAC1 and DAC3 were used at 0.2 weight percent in water.

Table 5 shows that both DAC1 and DAC3 give increased drainage rates.

TABLE 4

| PAM (lbs/Ton) | PAM Type | Colloid (lbs/Ton) | Colloid Type | Drainage Rate (mls/sec) |
|---|---|---|---|---|
| — | — | — | — | 1.38 |
| 1.0 | 292 | — | — | 1.37 |
| 1.0 | 292 | 1.0 | DAC1 | 1.86 |
| 1.0 | 292 | 2.0 | DAC1 | 1.75 |
| 1.0 | 292 | 1.0 | DAC3 | 1.44 |
| 1.0 | 292 | 2.0 | DAC3 | 1.45 |

EXAMPLE 5

An acid paper furnish was obtained from an operating paper mill having a total consistency of 0.58% (52% fiber, 48% fines), alum concentration of 81 ppm, (OH/Al ratio of 1.2), conductivity of 768 $\mu$mhos $cm^{-1}$, a cationic demand of 2.18 mg/100 g, and a pH of 5.1.

Two polyacrylamides, 4209A and 4240A and three colloids, DAC1, DAC3, and 2D5 were tested for effects on fines retention using the procedure outlined in Example 1.

DAC1 and DAC3 give superior fines retention compared to 2D5.

TABLE 5

| PAM (lbs/Ton) | PAM Type | Colloid (lbs/Ton) | Colloid Type | Fines Retention (%) |
|---|---|---|---|---|
| — | — | — | — | 24.2 |
| 2.0 | 4240A | — | — | 46.0 |
| 2.0 | 4240A | 2.0 | DAC1 | 64.0 |
| 2.0 | 4240A | 2.0 | DAC3 | 60.3 |
| 2.0 | 4240A | 2.0 | 2D5 | 49.3 |
| 2.0 | 4209A | — | — | 41.0 |
| 2.0 | 4209A | 2.0 | DAC1 | 68.3 |
| 2.0 | 4209A | 2.0 | DAC3 | 62.1 |
| 2.0 | 4209A | 2.0 | 2D5 | 55.1 |

EXAMPLE 6

An alkaline furnish as in Example 2 was used with the procedures outlined in Example 1 to determine what effect the degree of substitution of positive charge on the polyacrylamide would have on these systems.

These cationic polyacrylamides were all of the same high molecular weight with various degrees of substitution and were supplied by Delta Chemicals, Inc.

Clearly polyacrylamides with a medium charge or above are more effective then those with a very low or low charge. Although, small effects even at extremely low charge are observed. Again, DAC1 and DAC3 give better performance than 2D5.

TABLE 6

| PAM (lbs/Ton) | Degree of Substitution | IV (dl/g) | Charge Density (Equivalents N/kg polymer) | Colloid (lbs/Ton) | Colloid Type | Fines Retention (%) |
|---|---|---|---|---|---|---|
| — | — | — | — | — | — | 38.7 |
| 2.0 | Very Low | 18 | 0.01 | — | — | 41.4 |
| 2.0 | Very Low | 18 | 0.01 | 2.0 | DAC1 | 52.1 |
| 2.0 | Very Low | 18 | 0.01 | 2.0 | DAC3 | 57.7 |
| 2.0 | Very Low | 18 | 0.01 | 2.0 | 2D5 | 46.2 |
| 2.0 | Low | 18 | 0.06 | — | — | 41.3 |
| 2.0 | Low | 18 | 0.06 | 2.0 | DAC1 | 52.4 |
| 2.0 | Low | 18 | 0.06 | 2.0 | DAC3 | 61.2 |
| 2.0 | Low | 18 | 0.06 | 2.0 | 2D5 | 46.2 |
| 2.0 | Medium | 18 | 0.66 | — | — | 58.4 |
| 2.0 | Medium | 18 | 0.66 | 2.0 | DAC1 | 83.8 |
| 2.0 | Medium | 18 | 0.66 | 2.0 | DAC3 | 68.9 |
| 2.0 | Medium | 18 | 0.66 | 2.0 | 2D5 | 63.4 |
| 2.0 | Medium/High | 18 | 1.06 | — | — | 58.0 |
| 2.0 | Medium/High | 18 | 1.06 | 2.0 | DAC1 | 83.1 |
| 2.0 | Medium/High | 18 | 1.06 | 2.0 | DAC3 | 71.5 |
| 2.0 | Medium/High | 18 | 1.06 | 2.0 | 2D5 | 63.4 |
| 2.0 | High | 18 | 2.20 | — | — | 64.0 |
| 2.0 | High | 18 | 2.20 | 2.0 | DAC1 | 82.0 |
| 2.0 | High | 18 | 2.20 | 2.0 | DAC3 | 68.0 |
| 2.0 | High | 18 | 2.20 | 2.0 | 2D5 | 67.3 |

EXAMPLE 7

A protocol similar to that described in Example 6 was used to determine if these effects were also true for an acid furnish. An acid paper furnish similar to that described in Example 3 was used.

The trends exhibited in this example are very similar to those exhibited in Example 6 in that the higher charged polycrylamides give a much more marked effect but that even those polyacrylamides with a very low charge still give some effect. Again, DAC1 and DAC3 are superior to 2D5.

TABLE 7

| PAM (lbs/Ton) | Degree of Substitution | IV (dl/g) | Charge Density (equivalent N/kg polymer) | Colloid (lbs/Ton) | Colloid Type | Fines Retention (%) |
|---|---|---|---|---|---|---|
| — | — | — | — | — | — | 15.7 |
| 2.0 | Very Low | 18 | 0.01 | — | — | 24.9 |
| 2.0 | Very Low | 18 | 0.01 | 2.0 | DAC1 | 36.0 |
| 2.0 | Very Low | 18 | 0.01 | 2.0 | DAC3 | 44.3 |
| 2.0 | Very Low | 18 | 0.01 | 2.0 | 2D5 | 29.0 |
| 2.0 | Low | 18 | 0.78 | — | — | 37.1 |
| 2.0 | Low | 18 | 0.78 | 2.0 | DAC1 | 69.8 |
| 2.0 | Low | 18 | 0.78 | 2.0 | DAC3 | 70.5 |
| 2.0 | Low | 18 | 0.78 | 2.0 | 2D5 | 46.9 |
| 2.0 | Medium | 18 | 0.86 | — | — | 41.6 |
| 2.0 | Medium | 18 | 0.86 | 2.0 | DAC1 | 76.9 |
| 2.0 | Medium | 18 | 0.86 | 2.0 | DAC3 | 74.1 |
| 2.0 | Medium | 18 | 0.86 | 2.0 | 2D5 | 50.0 |
| 2.0 | Medium/High | 18 | 2.19 | — | — | 44.6 |
| 2.0 | Medium/High | 18 | 2.19 | 2.0 | DAC1 | 79.2 |
| 2.0 | Medium/High | 18 | 2.19 | 2.0 | DAC3 | 80.5 |
| 2.0 | Medium/High | 18 | 2.19 | 2.0 | 2D5 | 53.4 |
| 2.0 | High | 18 | 2.37 | — | — | 42.5 |

TABLE 7-continued

| PAM (lbs/Ton) | Degree of Substitution | IV (dl/g) | Charge Density (equivalent N/kg polymer) | Colloid (lbs/Ton) | Colloid Type | Fines Retention (%) |
|---|---|---|---|---|---|---|
| 2.0 | High | 18 | 2.37 | 2.0 | DAC1 | 69.5 |
| 2.0 | High | 18 | 2.37 | 2.0 | DAC3 | 73.4 |
| 2.0 | High | 18 | 2.37 | 2.0 | 2D5 | 47.1 |

EXAMPLE 8

The furnish and procedures outlined in Example 1 were utilized with the following modifications.

A cationic potato starch, having a degree of substitution of 0.036, was introduced into the system. It was prepared at 2 weight percent in distilled water. In the experiments where starch was utilized, the addition was made 10 seconds after the stirring was commenced.

The cationic polyacrylamide, 4240A, produced by Delta Chemicals, Inc., used in this example is a high molecular weight, high cationic charge polymer. It was prepared at 0.14 weight percent in water.

A colloidal silica sol, produced by Nalco Chemicals Company, was prepared at a concentration of 0.14 weight percent from a 15 weight percent commercial preparation. Nalco 1115 is a colloidal dispersion in water of silica particles in the form of tiny spheres with an average particle size of 4 mμ.

In Table 8 all colloids show a small improvement in fines retention with starch under these conditions. DAC1 and 2D5 show a significant improvement in fines retention in this furnish with the cationic polymer in the absence of cationic starch. There is significant synergy in the starch-polymer-colloid system particularly with DAC3 and silica. DAC1, DAC3 and silica appear to give the strongest response in these tertiary systems with 2D5 showing an inferior response.

TABLE 8

| PAM (lbs/Ton) | PAM Type | Starch (lbs/Ton) | Colloid (lbs/Ton) | Colloid Type | Fines Retention (%) |
|---|---|---|---|---|---|
| — | — | — | — | — | 33.2 |
| 2.0 | 4240A | — | — | — | 57.1 |
| — | — | 20 | — | — | 35.6 |
| 2.0 | 4240A | 20 | — | — | 56.0 |
| 2.0 | 4240A | — | 2.0 | DAC1 | 75.1 |
| 2.0 | 4240A | — | 2.0 | DAC3 | 56.9 |
| 2.0 | 4240A | — | 2.0 | 2D5 | 67.5 |
| 2.0 | 4240A | — | 2.0 | SILICA | 59.7 |
| — | — | 20 | 2.0 | DAC1 | 40.3 |
| — | — | 20 | 2.0 | DAC3 | 42.5 |
| — | — | 20 | 2.0 | 2D5 | 39.2 |
| — | — | 20 | 2.0 | SILICA | 41.2 |
| 2.0 | 4240A | 20 | 2.0 | DAC1 | 72.2 |
| 2.0 | 4240A | 20 | 2.0 | DAC3 | 68.5 |
| 2.0 | 4240A | 20 | 2.0 | 2D5 | 59.8 |
| 2.0 | 4240A | 20 | 2.0 | SILICA | 73.1 |

EXAMPLE 9

An acid paper furnish was obtained from an operating paper mill having a total consistency of 0.45% (49% fiber, 51% fines), a pH of 4.5, and a conductivity of 649 μmhos $cm^{-1}$.

The fines retention values were obtained as per procedures utilized in Example 8 with the following modifications.

The cationic potato starch was prepared at 1 weight percent in distilled water. The polyacrylamide, 4240A, along with the colloids, DAC1, DAC3, 2D5 and silica, were prepared at 0.07 weight percent in distilled water.

In Table 9, DAC3 is the only colloid that shows an improvement in fines retention with starch under these conditions. In the presence of the cationic polymer only, all of the colloids show a response with DAC1 and DAC3 giving the largest improvement in fines retention. In the tertiary system, starch-polymer-colloid, DAC1 and DAC3 again give the strongest responses with 2D5 and silica showing inferior responses.

TABLE 9

| PAM (lbs/Ton) | PAM Type | Starch (lbs/Ton) | Colloid (lbs/Ton) | Colloid Type | Fines Retention (%) |
|---|---|---|---|---|---|
| — | — | — | — | — | 27.9 |
| — | — | 20 | — | — | 53.3 |
| 2.0 | 4240A | — | — | — | 49.6 |
| 2.0 | 4240A | 20 | — | — | 59.4 |
| 2.0 | 4240A | — | 2.0 | DAC1 | 64.8 |
| 2.0 | 4240A | — | 2.0 | DAC3 | 62.0 |
| 2.0 | 4240A | — | 2.0 | 2D5 | 55.7 |
| 2.0 | 4240A | — | 2.0 | SILICA | 52.8 |
| — | — | 20 | 2.0 | DAC1 | 53.3 |
| — | — | 20 | 2.0 | DAC3 | 56.5 |
| — | — | 20 | 2.0 | 2D5 | 52.2 |
| — | — | 20 | 2.0 | SILICA | 53.2 |
| 2.0 | 4240A | 20 | 2.0 | DAC1 | 65.6 |
| 2.0 | 4240A | 20 | 2.0 | DAC3 | 73.2 |
| 2.0 | 4240A | 20 | 2.0 | 2D5 | 61.5 |
| 2.0 | 4240A | 20 | 2.0 | SILICA | 62.9 |

EXAMPLE 10

An acid mill furnish with the following characteristics was obtained: Total consistency 0.68% (66% fiber, 34% fines), pH=4.9, conductivity=740. This furnish was tested using various combinations of polymers and colloids to determine their effect on fines retention, drainage rate and formation. Fines retention was determined as outlined in Example 1, in addition a low shear testing procedure was also used so as to be able to compare the effect of shear on these retention systems. The low shear procedure consisted of adding the polymer to the furnish, in the Britt Jar, while being stirred at 1600 rpm. This speed was maintained for 10 seconds. The speed was then reduced to 1000 rpm, and the sample collection begun 5 seconds later. The speed was maintained at 1000 rpm during sample collection.

The same shearing procedures were used to prepare furnish for both drainage rate determination (see Example 1) and for hand sheet production. For hand sheet production a 12"×12" Noble and Wood sheet former was used. Formation index, average floc size and floc area, were determined with an M/K formation tester.

The polymer tested was 4209A and the colloids used were 2D5 and DAC1, all previously described.

Table 10 shows that when a high molecular weight polymer (4209A) is used, shear is essential after the addition of the polymer. If this shear is either absent or low, extremely high retentions and drainage are possible but the sacrifice in terms of formation is unacceptable. In a sheared system increased retentions and drainages are possible while not sacrificing as much in terms of formation.

TABLE 10

| Polymer | Colloid | Shear | Fines Retention (%) | Drainage Rate (mls/sec) | Formation Index | Average Floc Size ($mm^2$) | Floc Area (%) |
|---|---|---|---|---|---|---|---|
| 4209A | — | Low | 64.4 | 7.1 | 1.7 | 77.3 | 44.3 |
| 4209A | DAC1 | Low | 96.2 | 12.0 | 1.2 | 64.5 | 44.5 |
| 4209A | 2D5 | Low | 81.0 | 6.9 | 1.4 | 77.7 | 45.2 |
| 4209A | — | High | 55.2 | 4.4 | 3.9 | 27.7 | 34.8 |
| 4209A | DAC1 | High | 79.2 | 6.7 | 2.1 | 53.4 | 43.6 |
| 4209A | 2D5 | High | 67.3 | 5.7 | 3.7 | 36.8 | 35.0 |

Polymer at 2.0 lbs/Ton: Colloids at 2.0 lbs/Ton

We claim:

1. In a paper making process, the improvement that resides in adding a medium/high molecular weight cationic polymer having an intrinsic viscosity in the range 5 to 25 dl/g and having a charge density of 0.78 to 5 equivalents cationic nitrogen per kg to the furnish prior to its entry into a headbox, subjecting the furnish to which said polymer has been added to shear and thereafter adding a natural hectorite to the furnish prior to introducing it to the headbox without subjecting the furnish to any substantial further shearing, the amount of hectorite used being such as to result in the range of 0.5 to 6 lbs/ton dry base sheet and the weight ratio of medium/high molecular weight cationic polymer to hectorite being 0.5:1 to 10:1.

2. A paper making process according to claim 1, wherein said hectorite material has a particle size in the range 1–5 nm thickness and 250–500 nm in width and length.

3. A paper making process according to claim 1 wherein said medium/high molecular weight polymer has an intrinsic viscosity of 6 to 18 dl/g.

4. A paper making process according to claim 1, wherein said low molecular weight cationic polymer has a change density of from 0.5 to 3.5 equivalents of nitrogen per kg polymer.

5. A paper making process according to claim 1, wherein said medium/high molecular weight cationic polymer is a tertiary or quaternary amine derivative of polyacrylamide.

6. A paper making process according to claim 1, wherein said ratio is in the range 0.5:1 to 4:1.

7. A paper making process according to claim 1, wherein filler is employed in the furnish in an amount of from 50 to 300 lbs/ton dry base sheet.

8. A paper making process according to claim 7, wherein said filler is selected from kaolin, calcium carbonate, talc, titanium dioxide, barium sulfate and calcium sulfate.

9. A paper making process according to claim 1, wherein a charged starch is also present.

10. A paper making process according to claim 9, wherein said charged starch is a cationic starch having a degree of substitution in excess of 0.03.

11. A paper making process according to claim 10, wherein said charged starch is an amphoteric starch having a cationic degree of substitution in excess of 0.03.

12. A paper making process according to claim 1 wherein said furnish is subjected to shear stress of at least 1000 Pa after the addition of said polymer and prior to addition of hectorite.

13. A paper making process according to claim 12 wherein said furnish is subjected to a shear stress of at least 5000 Pa after addition of said polymer and prior to addition of hectorite.

14. A paper making process according to claim 13 wherein said furnish is subjected to a shear stress of about 10,000 Pa after addition of said polymer and prior to addition of hectorite.

15. A paper making process according to claim 12 wherein said furnish is not subjected to shear of greater than 1000 Pa after adding said hectorite.

* * * * *